US005411702A

United States Patent [19]

Nazmy et al.

[11] Patent Number: 5,411,702

[45] Date of Patent: May 2, 1995

[54] IRON-ALUMINUM ALLOY FOR USE AS THERMAL-SHOCK RESISTANCE MATERIAL

[75] Inventors: Mohamed Nazmy, Fislisbach; Corrado Noseda, Dietikon; Markus Staubli, Dottikon, all of Switzerland

[73] Assignee: ABB Management AG, Beden, Switzerland

[21] Appl. No.: 174,352

[22] Filed: Dec. 28, 1993

[30] Foreign Application Priority Data

Nov. 8, 1993 [EP] European Pat. Off. ..... 93118045.9

[51] Int. Cl.[6] ..... C22C 38/06

[52] U.S. Cl. ..... 420/79; 420/81

[58] Field of Search ..... 420/79, 81

[56] References Cited

U.S. PATENT DOCUMENTS 4,844,865 7/1989 Shimada et al. ..... 420/79
4,861,548 8/1989 Shimada et al. ..... 420/81

FOREIGN PATENT DOCUMENTS 648140 9/1962 Canada ..... 420/79
648141 9/1962 Canada ..... 420/79

*Primary Examiner*—Deborah Yee
*Attorney, Agent, or Firm*—Burns, Doane, Swecker & Mathis

[57] ABSTRACT

The iron-aluminum alloy comprises the following constituents in atom percent:

| | |
|---|---|
| 12–18 | aluminum |
| 0.1–10 | chromium |
| 0.1–2 | niobium |
| 0.1–2 | silicon |
| 0.1–5 | boron |
| 0.01–2 | titanium |
| 100–500 | ppm carbon |
| 50–200 | ppm zirconium |
| | remainder iron. |

This alloy is distinguished by high thermal-shock resistance and, at temperatures of 800° C., still has comparatively good mechanical properties. The alloy can be used advantageously in components such as, for example, casings of gas turbines, which, with comparatively low mechanical loading, are subject to frequent thermal cycling.

4 Claims, 1 Drawing Sheet

I = 16Al - 5Cr - 1Nb - 1Si - 3.53B - 1.51Ti - 300ppm C - 100ppm Zr - Rest Fe

II = 4.0Si - 3.35C - 1Mo - 0.3Mn - 0.01P - 0.05S - Rest Fe

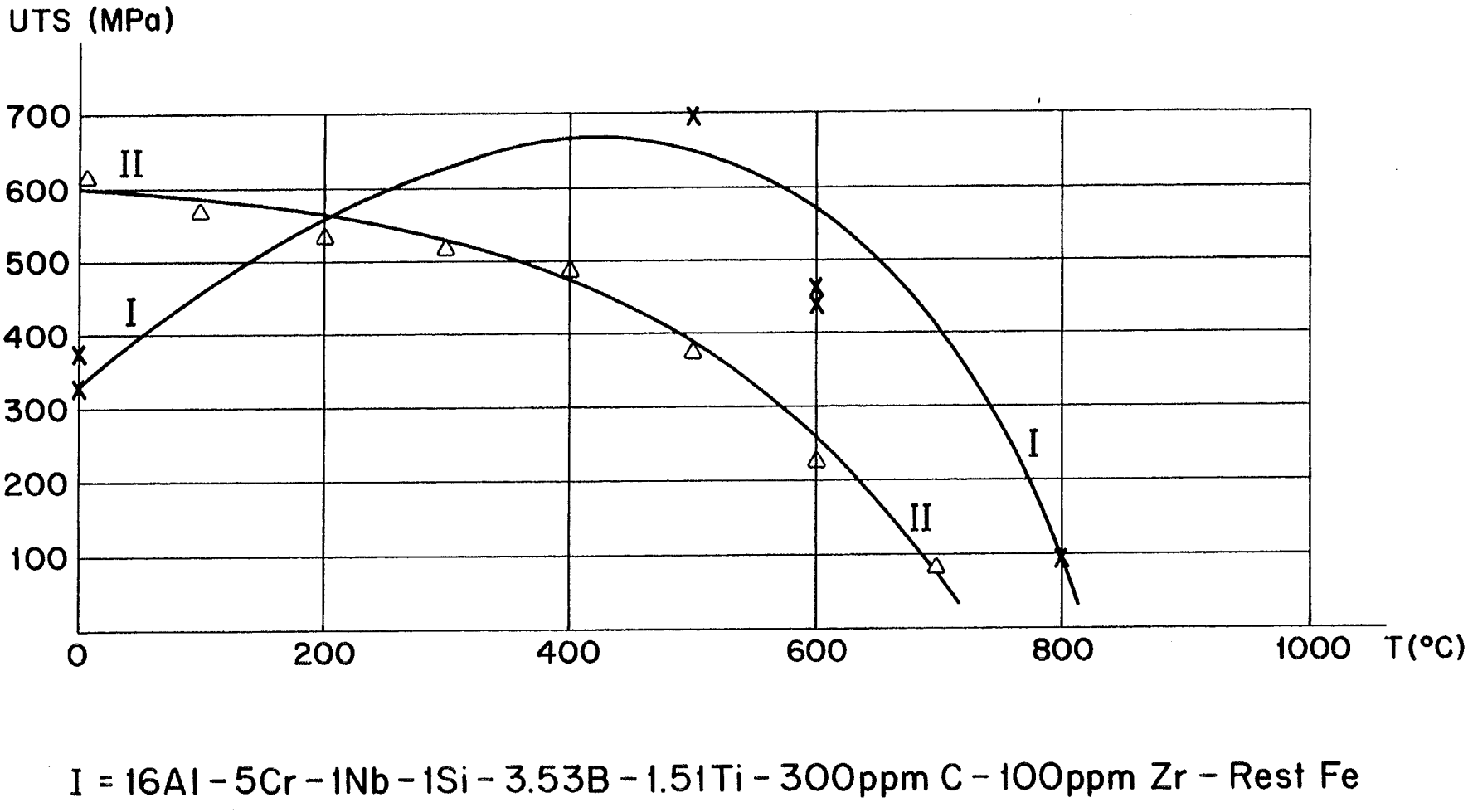
I = 16Al - 5Cr - 1Nb - 1Si - 3.53B - 1.51Ti - 300ppm C - 100ppm Zr - Rest Fe
II = 4.0Si - 3.35C - 1Mo - 0.3Mn - 0.01P - 0.05S - Rest Fe

IRON-ALUMINUM ALLOY FOR USE AS THERMAL-SHOCK RESISTANCE MATERIAL

BACKGROUND OF THE INVENTION

1. Field of the Invention

Iron-aluminum alloys can be used in parts, which are thermally highly stressed and exposed to oxidizing and/or corroding effects, of thermal machines. They are intended as an increasingly significant replacement in that area for special steels and nickel-based superalloys.

2. Discussion of Background

In the literature article "Acceptable Aluminium Additions for Minimal Environmental Effect in Iron-Aluminium Alloys", Mat. Res. Soc. Symp. Proc. Vol. 288, pp. 971–976, V. K. Sikka et al. describe an iron-aluminum alloy having a proportion of approximately 16 atom % of aluminum and approximately 5 atom % of chromium, which may contain, if required, approximately 0.1 atom % of carbon and/or zirconium and/or 1 atom % of molybdenum. The known alloy at room temperature has a considerably higher ductility compared to iron-aluminum alloys having an aluminum percentage of from 22 to 28 atom %. At a temperature of 700° C., the tensile strength of this alloy, being approximately 100 MPa, is relatively small. Components made from the alloy should therefore not be used at temperatures above 700° C.

SUMMARY OF THE INVENTION

Accordingly, one object of the invention is to provide a novel iron-aluminum alloy which is distinguished by good mechanical properties at temperatures above 700° C. Another object of the invention is a suitable use for this alloy.

The alloy according to the invention, even at temperatures between 700° and 800° C., still has mechanical properties which permit its use in components which are slightly stressed mechanically. At the same time, the alloy according to the invention is distinguished by excellent thermal shock resistance and can therefore be used particularly advantageously in those parts of thermal installations which are subject to thermal cyclic loading, such as, in particular, as a casing or casing part of a gas turbine or of a turbocharger or as a nozzle ring, in particular for a turbocharger. Moreover, the alloy can be produced very cost-effectively by casting or by casting and rolling. A further advantage of the alloy according to the invention arises from the fact that its constituents only contain metals which are comparatively inexpensive and are available independently of strategic political influences.

BRIEF DESCRIPTION OF THE DRAWING

The drawing shows a diagram in which the tensile strength UTS of an alloy I according to the invention and an alloy II according to the prior art is shown as a function of temperature T.

DESCRIPTION OF THE PREFERRED EMBODIMENTS

The invention is described below with reference to an embodiment described in more detail in the accompanying drawing wherein:

The single FIGURE shows a diagram in which the tensile strength UTS [MPa] of an alloy I according to the invention and an alloy II according to the prior art is shown as a function of the temperature T [°C.].

The alloys I and II specified in the FIGURE have the following compositions:

| Constituent | Atom % |
|---|---|
| Alloy I (alloy in accordance with a preferred embodiment of the invention): | |
| Aluminum | 16.00 |
| Chromium | 5.00 |
| Niobium | 1.00 |
| Silicon | 1.00 |
| Boron | 3.53 |
| Titanium | 1.51 |
| Carbon | 300 ppm |
| Zirconium | 100 ppm |
| Iron | remainder |
| Alloy II (alloy according to the prior art) | |
| Silicon | 4.00 |
| Carbon | 3.35 |
| Molybdenum | 1.00 |
| Manganese | 0.30 |
| Phosphorus | 0.01 |
| Sulfur | 0.05 |
| Iron | remainder |

The alloy I was smelted in an arc furnace under argon as the protective gas. The starting materials employed were the individual elements with a degree of purity of more than 99%. The melt was poured off to produce a casting having a diameter of approximately 100 mm and a height of approximately 100 mm. The casting was melted again under vacuum and cast, likewise under vacuum, in the form of round bars having a diameter of approximately 12 mm and a length of approximately 70 mm, in the shape of carrots having a minimum diameter of approximately 10 mm, a maximum diameter of approximately 16 mm and a length of approximately 65 mm, or in the form of discus-shaped disks having a disk diameter of 80 mm, a disk thickness of up to 14 mm and a radius at the disk rim of approximately 1 mm. In a further step, the discus-shaped disks each had a bore having a diameter of 19.5 mm sunk into them along the disk axis. From the round bars and carrots specimens were prepared for tensile tests. The disks were used for determining the thermal shock resistance. Appropriately sized specimens for determining the mechanical strength and the thermal shock resistance were prepared from the alloy II, which is commercially available and widely used as a material for gas turbine casings, and a related alloy having an approximately 25% smaller percentage of silicon and an approximately 40% smaller percentage of molybdenum, The tensile tests were carried out as a function of the temperature. The outcome, for the alloy I according to the invention, was a tensile strength which, at a temperature of 800° C., was approximately 100 MPa and thus considerably higher than that of the alloy II according to the prior art. The situation is similar for the prior art alloy, not shown in the FIGURE, with reduced silicon and molybdenum percentages.

With the aid of the discus-shaped disks, the thermal shock resistance according to Glenny was determined. Two disks each per alloy were, in a cyclic process in each case, heated to 650° C. in a fluidized bed and then cooled down to 200° C. with compressed air. After a certain number of such heating and cool-down cycles, the number of cracks which possibly formed on the rim of the disks and had a crack length of greater than 2 mm, were counted. The summed number of cracks arising on both disks as a function of the cycle number is specified below for the alloy I according to the invention and for the two alloys according to the prior art.

| Number of cycles | Number of cracks greater than 2 mm | | |
|---|---|---|---|
| | Alloy I (Invention) | Alloy II (Prior art) | Further alloy (Prior art) |
| 140 | 0 | 0 | 0 |
| 240 | 0 | 2 | 1 |
| 340 | 0 | 2 | 4 |
| 540 | 0 | 4 | 4 |
| 740 | 0 | 4 | 8 |

From this it can be seen that, in the case of the alloys according to the prior art conventionally used as a material for gas turbine casings, undesirable cracks occurred after as few as 240 cycles, whereas the alloy according to the invention remained free of cracks even after 740 cycles.

The alloy according to the invention surpasses comparably usable alloys according to the prior art, not only in terms of the mechanical strength at temperatures above 700° C., but also in terms of thermal shock resistance. The alloy according to the invention can therefore be used particularly advantageously as a material for components of thermal installations, which at temperatures between 700° C. and 800° C. still have a relatively high mechanical strength, and which, like gas turbine casings, are subject to strong thermal cyclic loading.

Good strength properties at temperatures between 700° and 800° C. and high thermal shock resistance are shown by alloys embodied according to the invention in those cases, where the aluminum content is at least 12 and at most 18 atom %. If the aluminum content drops below 12 atom %, the oxidation, corrosion and thermal shock resistance of the alloy according to the invention deteriorate. If the aluminum content is greater than 18 atom %, the alloy becomes increasingly brittle.

Alloying of from 0.1 to 10 atom % of chromium further increases the thermal shock, oxidation and corrosion resistance. Moreover, chromium improves the ductility. Adding more than 10 atom % of Cr, however, generally impairs again the mechanical properties.

Alloying of from 0.1 to 2 atom % of niobium increases the hardness and strength of the alloy according to the invention. In addition to, or instead of niobium it is also possible to alloy tungsten and/or tantalum with a percentage of from 0.1 to 2 atom %.

A percentage of from 0.1 to 2 atom % of silicon improves the castability of the alloy according to the invention and has a beneficial effect on its oxidation and corrosion resistance. Moreover, silicon has the effect of increasing the hardness.

Alloying of from 0.1 to 5 atom % of boron and from 0.01 to 2 atom % of titanium quite significantly increases the thermal shock, oxidation and corrosion resistance of the alloy according to the invention. This is primarily due to the formation, in that case, of finely dispersed titanium diboride $TiB_2$ in the alloy. At high temperatures and under oxidizing and/or corroding conditions, a protective layer is formed, containing predominantly aluminum oxides, on the surface of the alloy according to the invention. The titanium diboride phase contributes to a significant stabilization of this protective layer by projecting, for example in the form of needle-shaped crystallites, from the alloy into the protective layer and thus causing particularly good adhesion of the protective layer to the alloy situated below it. The percentage of boron should not exceed 5 atom % and that of titanium should not exceed 2 atom %, because otherwise too much titanium diboride is formed and the alloy becomes brittle. If the boron percentage is below 0.1 atom % and that of titanium below 0.01 atom %, the thermal shock, oxidation and corrosion resistance of the alloy according to the invention deteriorate quite considerably.

A slight increase in the mechanical strength and at the same time a considerable improvement of the weldability is achieved by alloying of from 100 to 500 ppm of carbon and from 50 to 200 ppm of zirconium.

Particularly good values of the mechanical strength and the thermal shock resistance are shown by alloys having the following composition:

| | |
|---|---|
| 14–16 | aluminum |
| 0.5–1.5 | niobium |
| 4–6 | chromium |
| 0.5–1.5 | silicon |
| 3–4 | boron |
| 1–2 | titanium |
| approximately 300 ppm carbon | |
| approximately 100 ppm zirconium | |
| remainder iron. | |

Obviously, numerous modifications and variations of the present invention are possible in the light of the above teachings. It is therefore to be understood that within the scope of the appended claims, the invention may be practiced otherwise than as specifically described herein.

What is claimed is:

1. An alloy on the basis of iron and aluminum, which comprises the following constituents in atom percent:

| | |
|---|---|
| 12–18 | aluminum |
| 0.1–10 | chromium |
| 0.1–2 | niobium |
| 0.1–2 | silicon |
| 0.1–5 | boron |
| 0.01–2 | titanium |
| 100–500 | ppm carbon |
| 50–200 | ppm zirconium |
| | remainder iron. |

2. The alloy as claimed in claim 1, which comprises the following constituents:

| | |
|---|---|
| 14–16 | aluminum |
| 0.5–1.5 | niobium |
| 4–6 | chromium |
| 0.5–1.5 | silicon |
| 3–4 | boron |
| 1–2 | titanium |
| approximately 300 ppm carbon | |
| approximately 100 ppm zirconium | |
| remainder iron. | |

3. The alloy as claimed in claim 1, wherein the alloy comprises a thermal-shock resistant material.

4. The alloy as claimed in claim 3, wherein the thermal-shock resistant material comprises a casing of a gas turbine.

* * * * *